US009777447B1

(12) United States Patent
Hipfl

(10) Patent No.: US 9,777,447 B1
(45) Date of Patent: Oct. 3, 2017

(54) SILT BARRIER SUPPORT SYSTEM

(71) Applicant: Stephen Hipfl, Frontenac, KS (US)

(72) Inventor: Stephen Hipfl, Frontenac, KS (US)

( * ) Notice: Subject to any disclaimer, the term of this patent is extended or adjusted under 35 U.S.C. 154(b) by 0 days.

(21) Appl. No.: 15/360,648

(22) Filed: Nov. 23, 2016

(51) Int. Cl.
*E01F 7/02* (2006.01)
*E02D 17/20* (2006.01)
*E02D 3/00* (2006.01)

(52) U.S. Cl.
CPC ..... *E01F 7/025* (2013.01); *E02D 3/005* (2013.01); *E02D 17/202* (2013.01); *E01F 7/02* (2013.01); *E02D 2300/0085* (2013.01)

(58) Field of Classification Search
CPC .. E04H 17/24; E01F 7/02; E01F 7/025; E02D 17/02; E02D 17/202; E02B 7/005
See application file for complete search history.

(56) References Cited

U.S. PATENT DOCUMENTS 1,226,465 A * 5/1917 Campbell ..... E04H 17/10 256/52
1,323,144 A * 11/1919 Alig ..... E04H 17/10 256/52
1,655,673 A * 1/1928 Cass ..... E04H 17/08 256/52
4,684,107 A 8/1987 Robbins
4,756,511 A * 7/1988 Wright, III ..... E04H 17/10 256/12.5
4,881,721 A 11/1989 Manley
5,108,224 A * 4/1992 Cabaniss ..... D03D 15/00 139/426 R
5,297,895 A * 3/1994 Johnson ..... E02B 11/00 405/37
5,660,505 A * 8/1997 Emory, III ..... E02D 29/02 24/543
5,758,868 A 6/1998 Shea
5,915,878 A * 6/1999 Carpenter ..... E02F 5/08 405/270
6,053,665 A * 4/2000 Richardson ..... E01F 7/04 256/12.5
6,398,459 B1 * 6/2002 Vreeland ..... E02D 17/202 37/367
6,619,627 B2 9/2003 Salisbury et al.
7,690,628 B2 4/2010 Hewitt et al.
2002/0172564 A1 * 11/2002 Brown ..... E02B 3/122 405/302.6
2007/0069191 A1 * 3/2007 Arnold ..... E01F 7/025 256/12.5
2007/0114506 A1 5/2007 McNeill
2008/0315169 A1 12/2008 McNeill
(Continued)

*Primary Examiner* — Frederick L Lagman
(74) *Attorney, Agent, or Firm* — Hovey Williams LLP

(57) ABSTRACT

A silt barrier support system broadly comprising a number of vertically extending posts, a number of silt barrier attachment devices, a number of end silt barrier attachment devices, and an inward silt barrier attachment device. The silt barrier attachment devices include vertical barbs for vertically retaining portions of an upper end of a geotextile fabric layer on upper portions of the posts. The end silt barrier attachment devices include horizontal barbs for laterally retaining end portions of the geotextile fabric layer on end posts. The inward silt barrier attachment device includes first and second sets of horizontal barbs for removing lateral slack from inward portions of the geotextile fabric layer.

13 Claims, 4 Drawing Sheets

(56) References Cited

U.S. PATENT DOCUMENTS

| | | | | |
|---|---|---|---|---|
| 2009/0095946 | A1* | 4/2009 | Bazzell | E01F 7/02<br>256/26 |
| 2011/0305530 | A1* | 12/2011 | Hunt | E02B 3/04<br>405/302.7 |
| 2015/0197958 | A1* | 7/2015 | Wilson | E01F 7/025<br>256/10 |

* cited by examiner

SILT BARRIER SUPPORT SYSTEM

BACKGROUND

Silt fences used for preventing silt runoff near construction sites and landscaping grounds often include a silt barrier made of a geotextile fabric layer stapled or tied to vertical posts extending upwards from the ground. Unfortunately, the geotextile fabric layer often tears at the staple or tie points especially near heavy water and silt flow areas. Sunlight also causes plastic zip ties used to tie the geotextile fabric to the posts to become brittle and break. Monitoring and repairing the silt fences is labor intensive and is often forgone. Workers often drive vehicles and heavy equipment over the silt fences because they do not have tools or replacement fasteners required to dismantle the silt fences and reattach the geotextile fabric layer to the posts. This results in silt fences being left damaged or in disarray, which allows silt runoff to build up or cause erosion. The silt buildup and/or erosion makes it difficult to re-build the silt fences, resulting in further damage to the construction site, landscaping grounds, or nearby areas.

SUMMARY

Embodiments of the invention solve the above-mentioned problems and provide a distinct advantage in the art of silt fence construction. More particularly, the invention provides a silt barrier support system that does not degrade or damage the silt barrier and is easily temporarily and partially dismantled for allowing vehicles to pass across the fenced area.

An embodiment of the silt barrier support system broadly comprises a number of vertically extending posts and a number of silt barrier attachment devices. The silt barrier support system may also include end silt barrier attachment devices and an inward silt barrier attachment device.

The vertically extending posts extend upwards from the ground surface and are spaced between three feet and ten feet apart from each other. The vertically extending posts may be formed of wood, metal, plastic, or any other suitable material. For example, the vertically extending posts may be 1.5 inch by 1.5 inch wooden stakes, molded plastic stakes, metal "T" posts, or the like.

The silt barrier attachment devices provide an interface for securing upper sections of a silt barrier to upper portions of the vertically extending posts. Each silt barrier attachment device broadly comprises a vertically extending member and a number of barbs. Each silt barrier attachment device may also include mounting structure and a cover. The vertically extending member supports the vertical barbs and may be a plate, bracket, board, or the like. The vertical barbs vertically retain an upper end of a portion of a geotextile fabric layer of the silt barrier and extend upwardly and outwardly from the vertically extending member. The vertical barbs may be arranged in horizontal rows and staggered vertical columns for distributing stresses in the geotextile fabric layer. The mounting structure allows the silt barrier attachment device to be permanently or removably attached to one of the vertically extending posts and may be fastener openings, hooks, clips, clamps, wire tires, or the like. The cover protects the vertical barbs and the penetrated upper portion of the geotextile fabric layer and may be hinged to the vertically extending member near an upper end thereof.

The end silt barrier attachment devices laterally secure end sections of the silt barrier to end posts and each broadly comprises a vertically extending member, a plurality of horizontal barbs, mounting structure, and a cover. The horizontal barbs laterally retain a lateral end portion of the geotextile fabric layer of the silt barrier and extend diagonally outwardly from the vertically extending member. The mounting structure and cover are substantially similar to the mounting structure and cover described above and will not be summarized further.

The inward silt barrier attachment device laterally secures inward portions of the geotextile fabric layer of the silt barrier to an inward post and broadly comprises a vertically extending member, a first set of horizontal barbs, a second set of horizontal barbs, mounting structure, and a cover. The first set of horizontal barbs laterally retain a left inward portion of the geotextile fabric layer and extend diagonally outwardly from the vertically extending member towards the second set of horizontal barbs. The second set of horizontal barbs laterally retain a right inward portion of the geotextile fabric layer and extend diagonally outwardly from the vertically extending member from the first set of horizontal barbs. Lateral slack can thus be accumulated centrally and effectively removed from the silt fence. The mounting structure and cover are substantially similar to the mounting structure and cover described above and will not be summarized further.

The above-described silt barrier support system provides several advantages over conventional systems. For example, the vertical barbs and horizontal barbs distribute local stresses so as to minimize tearing and stretching of the geotextile fabric layer near the barb penetrations. The barbs and/or mounting structure also allow sections of the geotextile fabric layer to be temporarily removed from the vertically extending posts, lowered, and then reattached without requiring replacement fasteners. Sections of the silt fence can thus be temporarily dismantled when a vehicle needs to traverse the fence and then re-erected after the vehicle has passed.

The silt barrier attachment devices can be repositioned on the vertically extending posts as needed and re-used for new silt fences. Attaching the geotextile fabric layer to the silt barrier attachment devices is less labor intensive than stapling or zip-tying the geotextile fabric layer to posts. The barbs do not become brittle and break and are reusable unlike zip ties and staples. The barbs are not prone to breaking even at the most critical locations along the silt fence. The resulting stronger silt fence does not require daily monitoring and repair. The silt barrier support system may also incorporate wooden stakes, molded plastic stakes, metal "T" posts, or any other suitable vertical member, thus making the silt barrier support system more versatile.

Another embodiment is a silt barrier attachment device broadly comprising a front vertically extending member, a rear vertically extending member, a bridge, mounting structure, a number of vertical barbs, and a number of wire reinforcement retaining elements. The front vertically extending member supports the vertical barbs. The rear vertically extending member is spaced from the front vertically extending member and supports the wire reinforcement retaining elements. The bridge connects the front vertically extending member and the rear vertically extending member together near their top ends so as to form a downward U-shaped component with a central open-ended space. The mounting structure allows the silt barrier attachment device to be permanently or removably attached to a vertically extending post.

The vertical barbs vertically retain an upper end of a portion of the geotextile fabric layer of the silt barrier and extend outwardly and upwardly from the front vertically extending member. The wire reinforcement retaining elements vertically retain an upper end of a portion of wire reinforcement of the silt barrier. The wire reinforcement retaining elements may be retaining geometry such as open-ended slits or grooves extending into the rear vertically extending member. Alternatively, the wire reinforcement retaining elements may be hooks, bosses, or other protrusions extending from the rear vertically extending member into the open-ended space.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
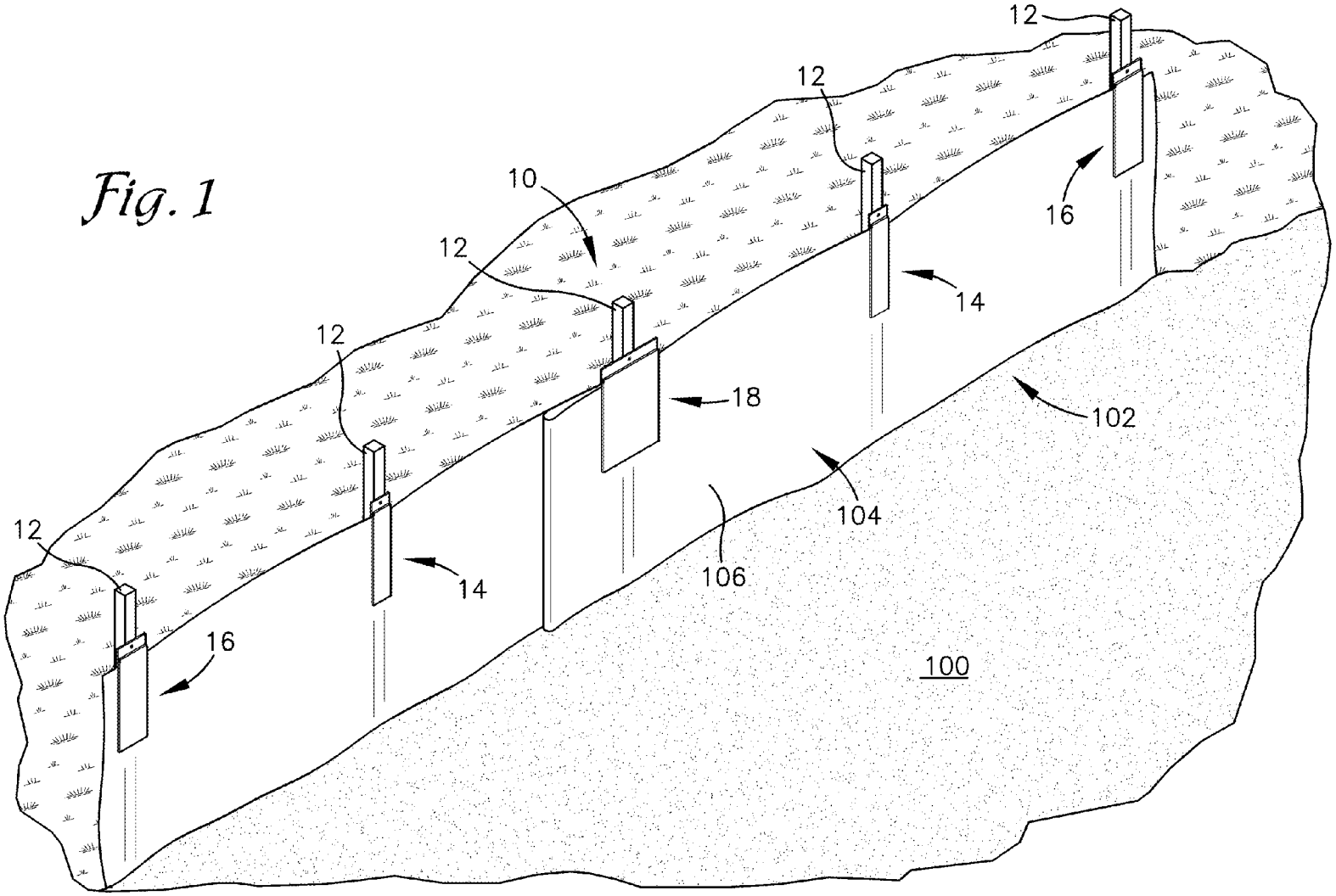
FIG. 1 is a perspective view of a silt barrier support system constructed in accordance with an embodiment of the invention.
Figure 2:
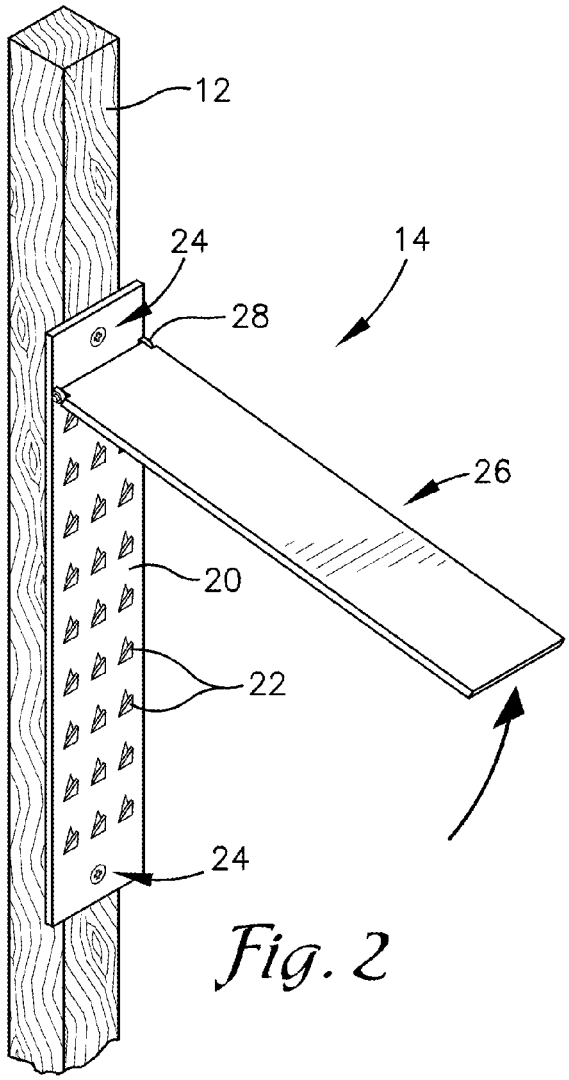
FIG. 2 is an enlarged perspective view of a silt barrier attachment device of the silt barrier support system of FIG. 1.
Figure 3:
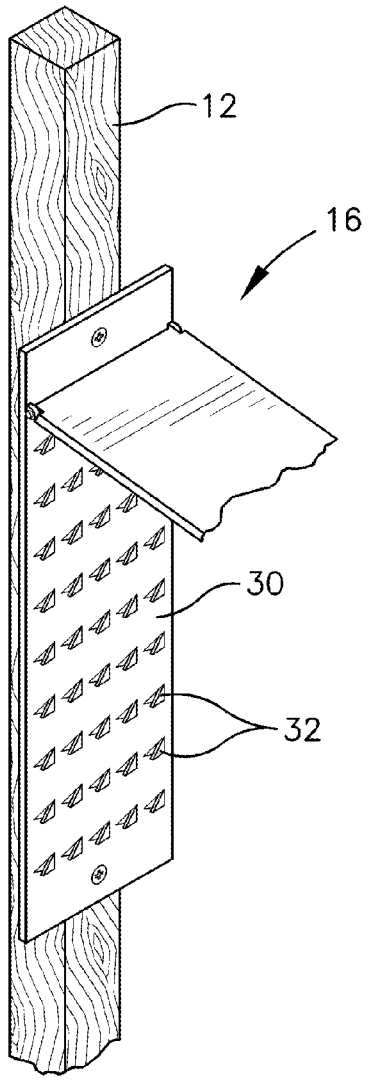
FIG. 3 is an enlarged perspective view of an end silt barrier attachment device of the silt barrier support system of FIG. 1.
Figure 4:
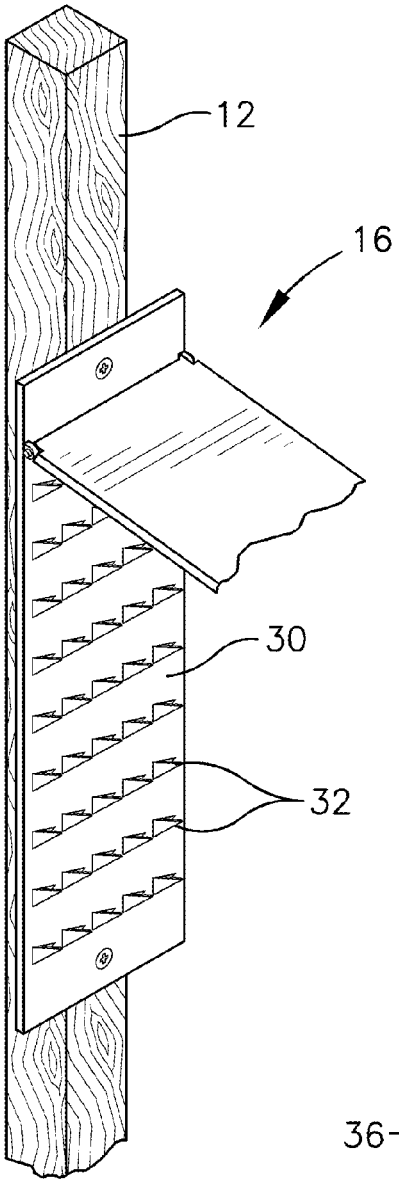
FIG. 4 is an enlarged perspective view of another end silt barrier attachment device of the silt barrier support system of FIG. 1.
Figure 5:
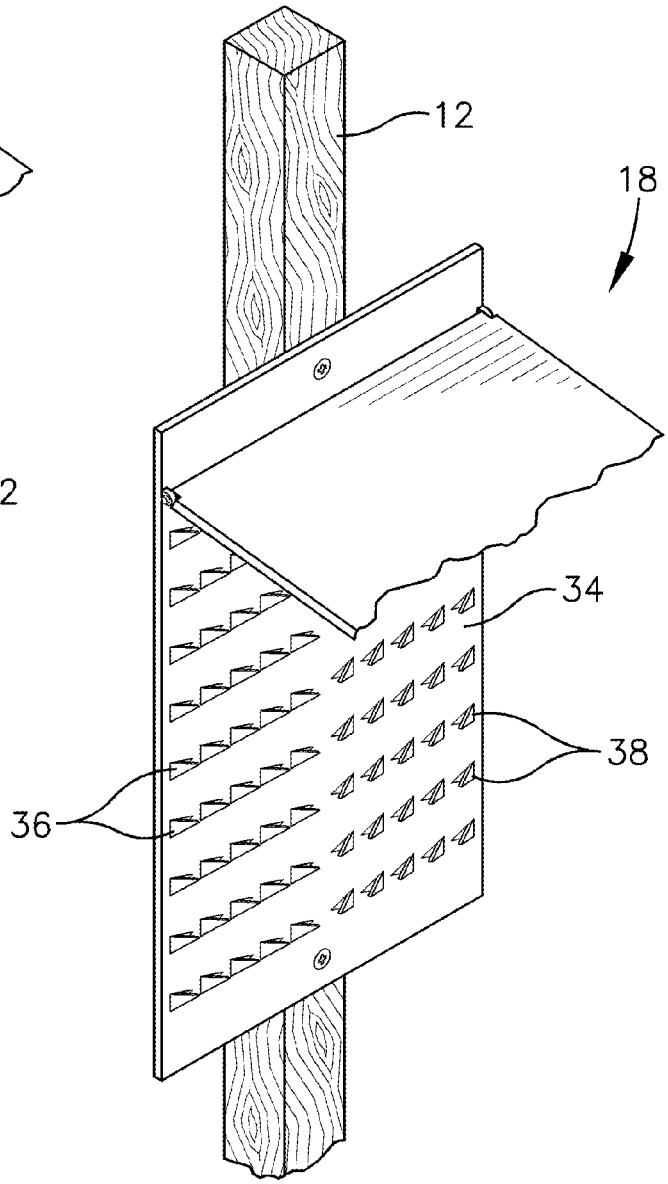
FIG. 5 is an enlarged perspective view of an inward silt barrier attachment device of the silt barrier support system of FIG. 1.
Figure 6:
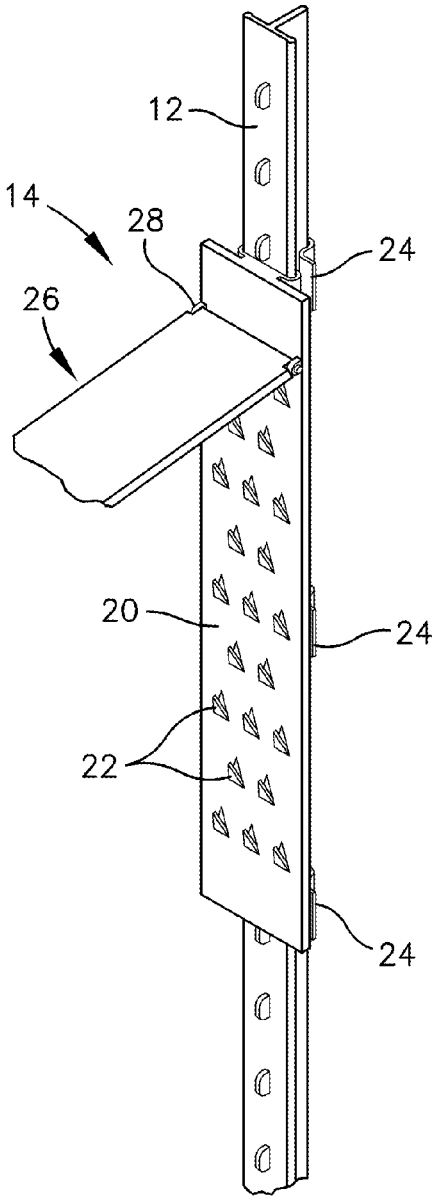
FIG. 6 is an enlarged perspective view of a silt barrier attachment device attached to a metal "T" post.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to FIGS. 1-6, a silt barrier support system 10 constructed in accordance with an embodiment of the invention is illustrated. The silt barrier support system 10 broadly comprises a plurality of vertically extending posts 12 and a plurality of silt barrier attachment devices 14. The silt barrier support system 10 may also include end silt barrier attachment devices 16 and an inward silt barrier attachment device 18.

The vertically extending posts 12 provide vertical structure to the silt barrier support system 10 and each may be between approximately two feet to approximately five feet in height. A bottom portion of each vertically extending post 12 may be configured to be inserted, anchored, or buried below a ground surface 100. An upper portion of each vertically extending post 12 may be configured to extend vertically above the ground surface 100 for erecting a silt fence 102. The vertically extending posts 12 may have mounting structure such as protrusions (FIG. 6) on the upper portion for attaching or retaining one of the silt barrier attachment devices 14. The vertically extending posts 12 may be formed of wood, metal, plastic, or any other suitable material. For example, the vertically extending posts 12 may be 1.5 inch by 1.5 inch wooden stakes (FIGS. 1-5), molded plastic stakes, metal "T" posts (FIG. 6), or the like.

The silt barrier attachment devices 14 provide an interface for securing upper sections of a silt barrier 104 to the upper portions of the vertically extending posts 12. Each silt barrier attachment device 14 broadly comprises a vertically extending member 20 and a plurality of vertical barbs 22. Each silt barrier attachment device 14 may also include a mounting structure 24 and a cover 26.

The vertically extending member 20 supports the vertical barbs 22 and may be a plate, bracket, board, or any other suitable member. The vertically extending member 20 may be between approximately two inches and approximately six inches wide and between approximately four inches and approximately twenty inches tall.

The vertical barbs 22 vertically retain an upper end of a portion of a geotextile fabric layer 106 of the silt barrier 104 and extend outwardly and upwardly from the vertically extending member 20. For example, the vertical barbs 22 may extend diagonally between approximately 10 degrees and approximately 80 degrees from vertical. The vertical barbs 22 may be arranged orthogonally or in horizontal rows and staggered vertical columns (FIG. 6) for distributing stresses in the geotextile fabric layer 106. The vertical barbs 22 may be pointed, wedge shaped, or pin shaped for penetrating the upper end of the portion of the geotextile fabric layer 106 without creating extended tears in the geotextile fabric layer 106.

The mounting structure 24 allows the silt barrier attachment device 14 to be permanently or removably attached to a vertically extending post 12 and may be one or more fastener openings extending through the vertically extending member 20 for receiving a screw, pin, or bolt therethrough. For example, a fastener opening may be positioned near a top and a bottom of the vertically extending member 20 for securing the silt barrier attachment device 14 to a wooden stake. Alternatively, the mounting structure 24 may be a hook, clip (FIG. 6), clamp, wire tie, or any other suitable mounting structure for securing the silt barrier attachment device 14 to a metal post. The silt barrier attachment devices 14 may also be integrally formed with the vertically extending posts, which would eliminate the need for mounting structure.

The cover 26 protects the vertical barbs 22 and the penetrated upper end of the portion of the geotextile fabric layer 106 from exposure to sunlight, wind, rain, and other wear and tear. The cover 26 may include a hinge 28 connecting the cover 26 near the top of the vertically extending member 20. The cover 26 may also include a latch, hook, lock, fastener, or other similar component for securing the cover 26 in a closed position. The cover 26 may be between approximately two inches and approximately six inches wide and between approximately four inches and approximately twenty inches tall for overlaying most or all of the vertically extending member 20.

The end silt barrier attachment devices 16 laterally secure end sections of the silt barrier 104 to end posts and each broadly comprises a vertically extending member 30, a plurality of horizontal barbs 32, and mounting structure and a cover similar to the mounting structure 24 and cover 26 described above. The vertically extending member 30 supports the horizontal barbs 32 in a horizontal arrangement and may be a plate, bracket, board, or any other suitable member. The vertically extending member 30 may be between approximately four inches and approximately twelve inches wide and between approximately four inches and approximately twenty inches tall.

The horizontal barbs 32 laterally retain a lateral end portion of the geotextile fabric layer 106 of the silt barrier 104 and extend diagonally outwardly and from the vertically extending member 30. For example, the horizontal barbs 32 may extend diagonally between approximately 10 degrees and approximately 80 degrees from the vertically extending member 30. The horizontal barbs 32 may be arranged orthogonally or in vertical columns and staggered horizontal rows for distributing stresses in the geotextile fabric layer 106. The horizontal barbs 32 may be pointed, wedge shaped, or pin shaped for penetrating the lateral end portion of the geotextile fabric layer 106 without creating extended tears in the geotextile fabric layer 106.

The inward silt barrier attachment device 18 laterally secures inward portions of the geotextile fabric layer 106 of the silt barrier 104 and broadly comprises a vertically extending member 34, a first set of horizontal barbs 36, a second set of horizontal barbs 38, and mounting structure and a cover similar to the mounting structure 24 and cover 26 described above. The vertically extending member 34 supports the first and second sets of horizontal barbs 36, 38 and may be a plate, bracket, board, or any other suitable member. The vertically extending member 34 may be between approximately four inches and approximately twelve inches wide and between approximately four inches and approximately twenty inches tall.

The first set of horizontal barbs 36 laterally retain a left inward portion of the geotextile fabric layer 106 of the silt barrier 104 and extend diagonally outwardly from the vertically extending member 34 towards the second set of horizontal barbs 38. For example, the first set of horizontal barbs 36 may extend diagonally between approximately 10 degrees and approximately 80 degrees from the vertically extending member 34.

The second set of horizontal barbs 38 laterally retain a right inward portion of the geotextile fabric layer 106 of the silt barrier 104 and are spaced from the first set of horizontal barbs 36. The second set of horizontal barbs 38 extend diagonally outwardly from the vertically extending member 34 towards the first set of horizontal barbs 36. For example, the second set of horizontal barbs 38 may extend diagonally between approximately 10 degrees and approximately 80 degrees from the vertically extending member 34 towards the first set of horizontal barbs 36. The first and second sets of horizontal barbs 36, 38 may be arranged orthogonally or in vertical columns and staggered horizontal rows for distributing stresses in the geotextile fabric layer 106. The horizontal barbs 36, 38 may be pointed, wedge shaped, or pin shaped for penetrating the lateral end portions of the geotextile fabric layer 106 without creating extended tears in the geotextile fabric layer 106.

Construction of the silt fence 102 will now be described in detail. First, a trench may be dug in the ground surface 100 perpendicular to the direction of potential silt runoff. Thus, the trench may closely follow a single elevation line along the ground surface 100. The vertically extending posts 12 may then be positioned in the trench such that lower portions of the vertically extending posts 12 are below the ground surface 100 and upper portions of the vertically extending posts 12 extend above the ground surface 100. The vertically extending posts 12 may be spaced apart from each other between approximately two feet and approximately fifteen feet. The silt barrier 104 may then be unrolled or laid out along the trench so that a lower end of the silt barrier 104 is positioned in the trench. The trench may then be filled in with dirt, gravel, or a similar material so that the lower end of the silt barrier 104 and the lower portions of the vertically extending post 12 are anchored or buried below the ground surface 100.

The silt barrier attachment devices 14, end silt barrier devices 16, and inward silt barrier attachment device 18 may then be mounted onto the upper portions of the vertically extending posts 12 between approximately twelve inches and approximately 48 inches above the ground surface 100 via the mounting structure 24 or similar means. For example, the silt barrier attachment devices 14, 16, 18 may be attached to wooden posts via woodscrews or attached to metal T-posts or poles via clips (FIG. 6) or wire ties. Specifically, the end silt barrier devices 16 may be mounted on end posts, the inward silt barrier attachment device 18 may be mounted on an inward post, and the silt barrier attachment devices 14 may be mounted on the remainder of the posts.

Portions of an upper end of the silt barrier 104 may then be raised to be level with some of the silt barrier attachment devices 14 and attached to the silt barrier attachment devices 14 via the vertical barbs 22. More specifically, vertical slack in portions of a geotextile fabric layer 106 may be removed and upper ends of these portions of the geotextile fabric layer 106 may be penetrated by the vertical barbs 22 of the silt barrier attachment devices 14 such that it vertically retains the upper ends of these portions of the geotextile fabric layer 106.

An end section of the silt barrier 104 may then be secured to one of the end silt barrier attachment devices 16. More specifically, lateral slack near a lateral end of the geotextile fabric layer 106 may be removed and the lateral end of the geotextile fabric layer 106 may be penetrated with the horizontal barbs 32 of the end silt barrier attachment device 16 such that it laterally retains the lateral end of the geotextile fabric layer 106. The opposite end section of the silt barrier 104 may also be secured to the other end silt barrier attachment device 16. It will be understood that the steps of securing lateral ends of the silt barrier 104 to the end silt barrier attachment devices 16 may be performed before the step of securing portions of the upper end of the silt barrier 104 to the silt barrier attachment devices 14.

Inward sections of the silt barrier 104 may also be secured to the inward silt barrier attachment device 18 for removing slack in the silt fence 102. More specifically, lateral slack near a first inward portion of the geotextile fabric layer 106 may be removed so that it accumulates opposite the first inward portion. The first inward portion may then be penetrated by the first set of horizontal barbs 36 so that the lateral slack remains accumulated opposite the first inward portion. Additional lateral slack near a second inward portion spaced from the first inward portion may also be removed so that it accumulates opposite the second inward portion along with the previously accumulated slack. The second inward portion may then be penetrated by the second set of horizontal barbs 38 so that the additional lateral slack remains accumulated between the first and second inward portions. In this way, the inward silt barrier attachment device 18 laterally retains the first and second inward portions of the geotextile fabric layer 106 while retaining accumulated lateral slack between the first and second inward portions. The accumulated lateral slack may then be rolled up or folded over to one side. It will be understood that the step of securing the inward sections of the silt barrier 104 to the inward silt barrier attachment device 18, and hence accumulating the lateral slack may be performed before the step of securing portions of the upper end of the silt barrier 104 to the silt barrier attachment devices 14.

The above-described silt barrier support system 10 provides several advantages over conventional systems. For example, the vertical barbs 22 and horizontal barbs 32, 36, 38 distribute local stresses so as to minimize tearing and stretching of the geotextile fabric layer 106 near the barb penetrations. The barbs 22, 32, 36, 38 and/or mounting structure also allow sections of the geotextile fabric layer 106 to be temporarily removed from the vertically extending posts 12, lowered, and then reattached without requiring replacement fasteners. Sections of the silt fence 102 can thus be temporarily dismantled when a vehicle needs to traverse the fence and then re-erected after the vehicle has passed.

The silt barrier attachment devices 14, 16, 18 can be repositioned on the vertically extending posts 12 as needed and re-used for new silt fences. Attaching the geotextile fabric layer 106 to the silt barrier attachment devices 14, 16, 18 is less labor intensive than stapling or zip-tying the geotextile fabric layer 106 to posts. The barbs 22, 32, 36, 38 do not become brittle and break and are reusable unlike zip ties and staples. The barbs 22, 32, 36, 38 are not prone to breaking even at the most critical locations along the silt fence 102. The resulting stronger silt fence 102 does not require daily monitoring and repair. The silt barrier support system 10 may also incorporate wooden stakes, molded plastic stakes, metal "T" posts, or any other suitable vertical member, thus making the silt barrier support system 10 more versatile.

Figure 7:
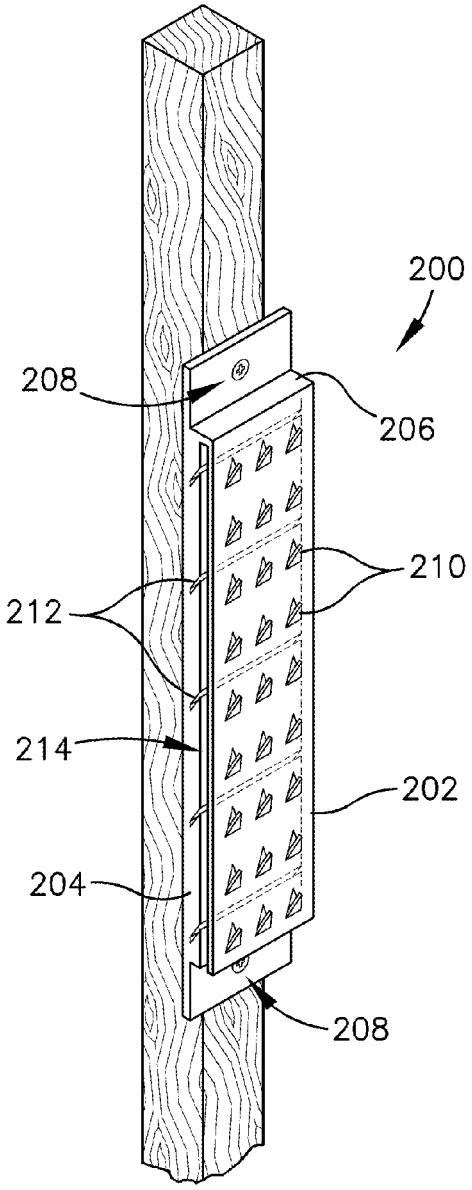
FIG. 7 is an enlarged perspective view of a silt barrier attachment device constructed in accordance with another embodiment of the invention.

Another embodiment is a silt barrier attachment device 200 broadly comprising a front vertically extending member 202, a rear vertically extending member 204, a bridge 206, mounting structure 208, a plurality of vertical barbs 210, and a plurality of wire reinforcement retaining elements 212, as shown in FIG. 7. The silt barrier attachment device 200 may be used with a silt barrier that includes a geotextile fabric layer and a wire reinforcement.

The front vertically extending member 202 supports the vertical barbs 210 in a vertical arrangement and may be between approximately two inches and approximately six inches wide and between approximately four inches and approximately twenty inches tall. The front vertically extending member 202 may be a plate, bracket, board, or any other suitable member.

The rear vertically extending member 204 supports the wire reinforcement retaining elements 212 and may be between approximately two inches and approximately six inches wide and between approximately four inches and approximately twenty inches tall. The rear vertically extending member 204 may be spaced from the front vertically extending member 202 between approximately one fourth of an inch and approximately two inches and may be a plate, bracket, board, or any other suitable member similar to the front vertically extending member 202.

The bridge 206 connects the front vertically extending member 202 to the rear vertically extending member 204 near upper ends of the front vertically extending member 202 and rear vertically extending member 204 so as to form a downward U-shaped component with an open-ended space 214. The bridge 206 may be integrated with the front vertically extending member 202 and the rear vertically extending member 204 so as to form a single unitary piece. Alternatively, the bridge 206 may be a combination of fasteners, brackets, clamps, and/or spacers connecting the front vertically extending member 202 and the rear vertically extending member 204 together.

The mounting structure 208 allows the silt barrier attachment device 200 to be permanently or removably attached to a vertically extending post and may be one or more fastener openings extending through the rear vertically extending member 204 for receiving a screw, pin, or bolt therethrough. For example, a fastener opening may be positioned near a top and a bottom of the vertically extending member 204 for securing the silt barrier attachment device 200 to a wooden stake. Alternatively, the mounting structure 208 may be a hook, clip, clamp, wire tie, or any other suitable mounting structure for securing the silt barrier attachment device 200 to a metal post.

The vertical barbs 210 vertically retain an upper end of a portion of the geotextile fabric layer of the silt barrier and extend outwardly and upwardly from the front vertically extending member 202. For example, the vertical barbs 210 may extend diagonally between approximately 10 degrees and approximately 80 degrees from vertical. The vertical barbs 210 may be arranged in horizontal rows and staggered vertical columns for distributing stresses in the geotextile fabric layer. The vertical barbs 210 may be pointed, wedge shaped, or pin shaped for penetrating an upper end of the portion of the geotextile fabric layer without creating extended tears in the geotextile fabric layer.

The wire reinforcement retaining elements 212 vertically retain an upper end of a portion of the wire reinforcement of the silt barrier and may be retaining geometry such as open-ended slits or grooves extending into the rear vertically extending member 204. Alternatively, the wire reinforcement retaining elements 210 may be hooks, bosses, or other protrusions extending from the rear vertically extending member 204. The wire reinforcement retaining elements 212 may be angled or turned upwards or diagonally upwards for catching the upper end of the portion of the wire reinforcement. It will be understood that the vertical barbs 210 and the wire reinforcement retaining elements 212 may be positioned, in any combination or variation, on a front face of the front vertically extending member 202, a rear face of the front vertically extending member 202, and a front face of the rear vertically extending member 204.

Use of the silt barrier attachment device 200 is similar to the silt barrier attachment device 14 described above except that upper ends of portions of the wire reinforcement are vertically retained by the wire reinforcement retaining elements 212. To achieve this, vertical slack in a portion of the wire reinforcement is removed. An upper end of the portion of the wire reinforcement is then inserted into the open-ended space 214 and engaged on the wire reinforcement retaining elements 212.

The above-described silt barrier attachment device 200 provides several advantages. For example, the silt barrier attachment device 200 allows a silt barrier having a geotextile fabric layer and a wire reinforcement to be removably secured to a vertical post. The wire reinforcement retaining elements 212 may be shaped specifically for a particular wire reinforcement pattern or shape so that the wire reinforcement is not bent or damaged when retained by the silt barrier attachment device 200.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method of constructing a silt fence along a ground surface, the method comprising the steps of:

positioning lower ends of a plurality of vertically extending posts in a ground surface such that the vertically extending posts are laterally spaced from each other;

securing a lower end of a silt barrier below the ground surface, the silt barrier comprising a geotextile fabric layer;

securing sections of an upper end of the silt barrier to silt barrier attachment devices vertically spaced from the ground surface on the vertically extending posts, wherein securing one of the sections of the upper end of the silt barrier to one of the silt barrier attachment devices comprises:

removing vertical slack in a portion of the geotextile fabric layer, and penetrating an upper end of the portion of the geotextile fabric layer with outwardly and upwardly extending barbs of the silt barrier attachment device such that the silt barrier attachment device vertically retains the upper end of the portion of the geotextile fabric layer; and further comprising the step of securing first and second inward sections of the silt barrier to an inward silt barrier attachment device, wherein securing the first and second inward sections of the silt barrier to the inward silt barrier attachment device comprises:

removing lateral slack near first and second inward portions of the geotextile fabric layer so as to accumulate lateral slack between the first and second inward portions of the geotextile fabric layer;

penetrating the first inward portion of the geotextile fabric layer with a first set of barbs of the inward silt barrier device; and penetrating the second inward portion of the geotextile fabric layer with a second set of barbs of the inward silt barrier device, the first set of barbs and the second set of barbs extending outwardly and laterally towards each other so as to laterally retain the first and second inward portions of the geotextile fabric layer.

2. The method of claim 1, further comprising the step of forming a trench in the ground and positioning the lower end of the silt barrier in the trench, the step of securing the lower end of the silt barrier near the ground surface including filling in the trench so that the lower end of the silt barrier is anchored in the ground.

3. The method of claim 1, wherein the silt barrier attachment devices are integrally formed with the posts.

4. The method of claim 1, further comprising the step of mounting the silt barrier attachment devices onto the posts.

5. The method of claim 4, wherein the step of mounting the silt barrier attachment devices onto the posts includes connecting mounting clips of the silt barrier attachment devices to the posts.

6. The method of claim 1, wherein the silt barrier further comprises a wire reinforcement, and securing a section of the upper end of the silt barrier to one of the silt barrier attachment devices further comprises removing vertical slack in a portion of the wire reinforcement and engaging an upper end of the portion of the wire reinforcement on wire retaining geometry of the silt barrier attachment device such that the silt barrier attachment device vertically retains the upper end of the portion of the wire reinforcement.

7. The method of claim 1, further comprising the step of securing an end section of the silt barrier to an end silt barrier attachment device, wherein securing the end section of the silt barrier to the end silt barrier attachment device comprises:

removing lateral slack near a lateral end of the geotextile fabric layer; and penetrating the lateral end of the geotextile fabric layer with outwardly and laterally extending barbs of the end silt barrier attachment device such that the end silt barrier attachment device laterally retains the lateral end of the geotextile fabric layer.

8. A silt barrier support system for erecting a silt fence having a silt barrier, the silt barrier including a geotextile fabric layer, the silt barrier support system comprising:

a plurality of posts configured to be laterally spaced apart from each other and positioned at least partially below a ground surface so as to extend at least partially above the ground surface;

a plurality of silt barrier attachment devices configured to be mounted on the posts for securing sections of an upper end of the silt barrier to the posts, each silt barrier attachment device comprising:

a vertically extending member; and a plurality of barbs extending outwardly and upwardly from the vertically extending member for penetrating an upper end of a portion of the geotextile fabric layer for vertically retaining the upper end of the portion of the geotextile fabric layer; and further comprising an end silt barrier attachment device comprising a vertically extending member and a plurality of barbs extending outwardly and laterally from the vertically extending member of the end silt barrier attachment device for penetrating a lateral end of the geotextile fabric layer for laterally retaining the lateral end of the geotextile fabric layer.

9. The silt barrier support system of claim 8, wherein the silt barrier further includes a wire reinforcement, each silt barrier attachment device further comprising wire retaining geometry for engaging and vertically retaining an upper end of a portion of the wire reinforcement.

10. The silt barrier support system of claim 9, wherein the wire retaining geometry is a plurality of angled open-ended slits.

11. The silt barrier support system of claim 9, wherein each silt barrier attachment device further comprises a secondary vertically extending member including the wire retaining geometry.

12. The silt barrier support system of claim 8, wherein each silt barrier attachment device further comprises a mounting clip configured to retain the silt barrier attachment device on one of the posts.

13. A silt barrier support system for erecting a silt fence having a silt barrier, the silt barrier including a geotextile fabric layer, the silt barrier support system comprising:

a plurality of posts configured to be laterally spaced apart from each other and positioned at least partially below a ground surface so as to extend at least partially above the ground surface;

a plurality of silt barrier attachment devices configured to be mounted on the posts for securing sections of an upper end of the silt barrier to the posts, each silt barrier attachment device comprising:

a vertically extending member; and a plurality of barbs extending outwardly and upwardly from the vertically extending member for penetrating an upper end of a portion of the geotextile fabric layer for vertically retaining the upper end of the portion of the geotextile fabric layer; and further comprising an inward silt barrier attachment device comprising a vertically extending member, a first set of barbs, and a second set of barbs, the first set of barbs and the second set of barbs extending outwardly and laterally towards each other from the vertically extending member of the inward silt barrier attachment device for penetrating first and second inward portions of the geotextile fabric layer so as to laterally retain the first and second inward portions of the geotextile fabric layer with lateral slack being accumulated between the first and second inward portions.

* * * * *